US006674275B2

(12) United States Patent
Darzy

(10) Patent No.: US 6,674,275 B2
(45) Date of Patent: Jan. 6, 2004

(54) CURRENT SOURCE UTILIZING A TRANSCONDUCTANCE AMPLIFIER AND A LOWPASS FILTER

(75) Inventor: Saul Darzy, Edgware (GB)

(73) Assignee: STMicroelectronics Limited, Almondsbury Bristol (GB)

( * ) Notice: Subject to any disclaimer, the term of this patent is extended or adjusted under 35 U.S.C. 154(b) by 0 days.

(21) Appl. No.: 10/076,206

(22) Filed: Feb. 14, 2002

(65) Prior Publication Data

US 2002/0140413 A1 Oct. 3, 2002

(30) Foreign Application Priority Data

Feb. 15, 2001 (GB) ..... 01301317

(51) Int. Cl.[7] ..... G05F 3/16

(52) U.S. Cl. ..... 323/316; 323/317; 327/379; 327/539

(58) Field of Search ..... 326/30; 327/551, 327/558, 379, 539, 538; 323/316, 317

(56) References Cited

U.S. PATENT DOCUMENTS

| | | | | |
|---|---|---|---|---|
| 3,805,091 A | * | 4/1974 | Colin | 327/555 |
| 5,594,382 A | | 1/1997 | Kato et al. | |
| 5,721,484 A | | 2/1998 | Ngo et al. | |
| 5,923,217 A | | 7/1999 | Durec | |
| 5,973,516 A | * | 10/1999 | Bremner et al. | 327/74 |
| 6,057,727 A | | 5/2000 | Dautriche et al. | |
| 6,150,885 A | * | 11/2000 | Ashby et al. | 330/257 |

* cited by examiner

*Primary Examiner*—Shawn Riley
(74) *Attorney, Agent, or Firm*—Wolf, Greenfield & Sacks, P.C.; James H. Morris

(57) ABSTRACT

A current source circuit is described for generating control current. The circuit is capable of generating a very accurate reference current and in particular dealing with the problem which can arise from injected noise. A feedback loop is implemented to reject the charge injection noise.

4 Claims, 2 Drawing Sheets

Q2
I.C.
Vref
NA
Rext
Cpar
Iinj
V
t
t
Iinj

Transconductance Amplifier Gm
8
Low-Pass Filter H
6
Vin
Ro
Comparator
10
+
-
Control Current Generator
4
Ic
Reference Current Generator
2
Iref

CURRENT SOURCE UTILIZING A TRANSCONDUCTANCE AMPLIFIER AND A LOWPASS FILTER

FIELD OF THE INTENTION

The present invention relates to a current source.

BACKGROUND OF THE INVENTION

Numerous current source configurations are known which are intended to provide a current level (referred to herein as the control current) according to a predetermined reference level. That reference level is in some circuits set by a separately supplied and accurately generated reference current Iref. One of the difficulties which can exist is that noise is injected into the reference current before it is used to control the value of the control current. Thus, errors arise in the value of the control current which attempts to match the noise affected reference current.

FIG. 1A serves to illustrate the problem of injected noise. A chip I.C. is illustrated with an external pin represented by node NA. An external resistor $R_{ext}$ attached to the pin is used to generate a very accurate reference current with high precision. On that pin, there can however exist a parasitic capacitor. If there is a ramping signal with high voltage at high frequency, which is sometimes the case in some switching power applications, currents $I_{inj}$ can be injected at the node NA. That current will pass through the transistor labelled Q2 in FIG. 1A and affect the accuracy of the reference current.

SUMMARY OF THE INVENTION

It is an aim or the present invention to provide an improved current source which overcomes this defect.

According to the present invention there is provided a current source for generating a control current comprising: a reference current generator having a first output impedance and connected to supply a reference current to a circuit node; a control current generator having a second output impedance and connected to supply said control current to said circuit node, whereby an input voltage is generated at said circuit node based on the reference current, the control current and the first and second output impedances; a filter circuit connected to staid circuit node and arranged to filter said input voltage; and an amplifier connected to receive the filtered input voltage and arranged to control the level of the control current in dependence on the filtered input voltage.

In the described embodiment, the amplifier is a transconductance amplifier which comprises an NMOS transistor having its source connected to a resistive component and its gate connected to receive the filtered input voltage. Its drain is connected to the control current generator.

In the described embodiment the control current generator comprises a current source connected to a current mirror circuit which supplies the control current to said circuit node.

In the described embodiment the filter circuit comprises a resistive component connected between said circuit node and the amplifier input, and a capacitor connected between said resistor and a voltage supply terminal. With the polarities given in the following description, the capacitor is connected between one terminal of the resistor and ground. A further capacitor can be included within the filter connected between the other terminal of the resistor and ground.

For a better understanding of the present invention and to show how the same may be carried into effect, reference will now be made by way of example to the accompanying drawings.

DETAILED DESCRIPTION OF EMBODIMENTS OF THE PRESENT INVENTION

Figures 1A, 1B:
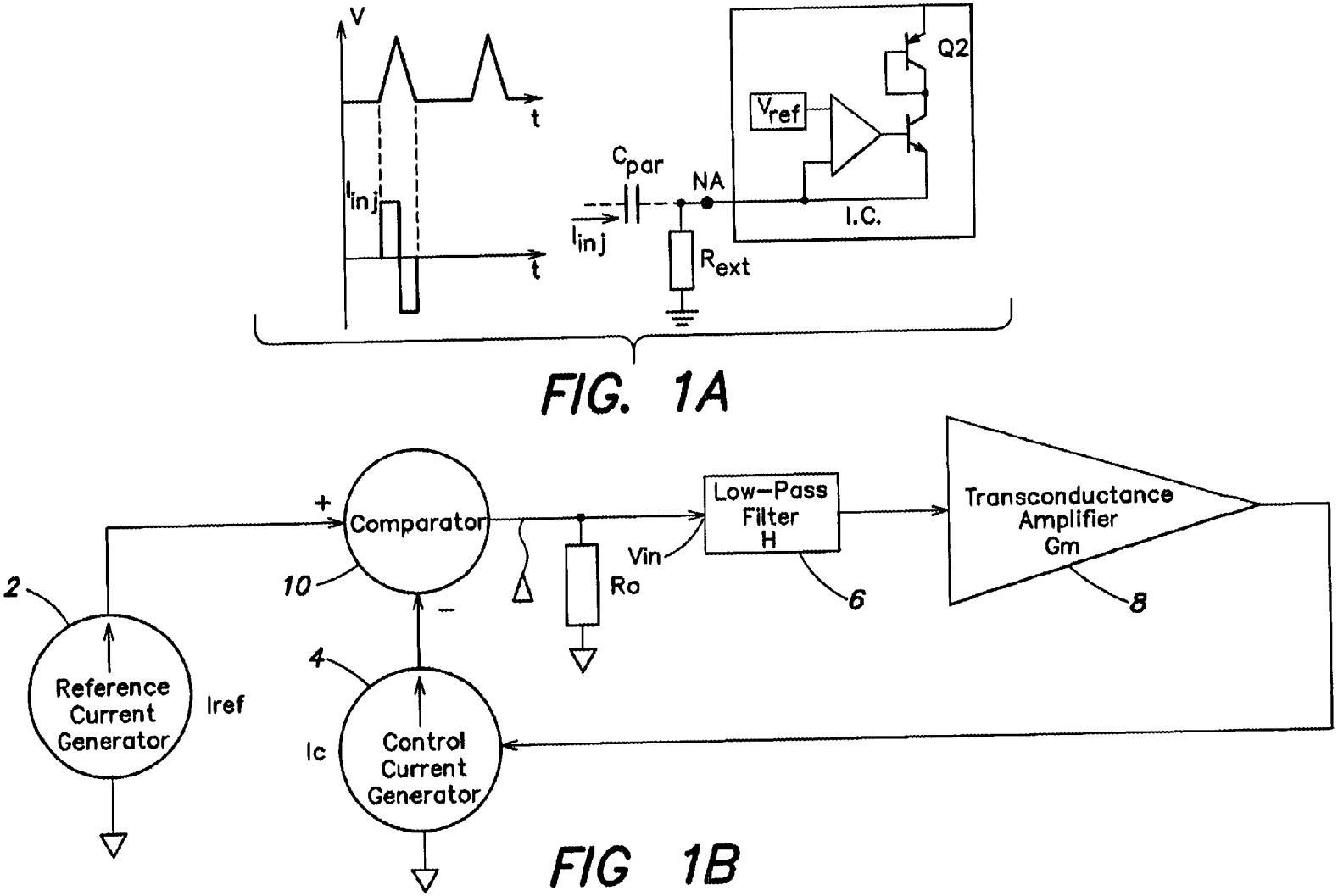
FIG. 1A is a schematic diagram illustrating the problem of injected noise.
FIG. 1B is a schematic block diagram of a current source.

The principles of the current source of the preferred embodiment will firstly be described with reference to FIG. 1B. A first current generator 2 is provided to generate an accurate reference current Iref. The aim of the circuit components on the right hand side of the block diagram of FIG. 1B is to generate a control current Ic which tracks the reference current as closely as possible. The circuit components to do this comprise a second current generator 4, a low pass filter 6 and a transconductance amplifier 8. The second current generator 4 generates the control current Ic which is compared with the reference current Iref at a comparator 10. The resulting difference signal Δ is supplied to the low pass filter 6 as a voltage Vin generated across a resistor R0. The filtered voltage at the output of the low pass filter 6 is supplied to the input of the transconductance amplifier 8 and the output of that amplifier is supplied to control the second current generator 4.

Thus, the circuit comprises a feedback loop to control the level of the control current Ic according to the level of the accurate reference current Iref. The circuit incorporates the low pass filter 6 in order to filter out noise which can be injected such as to affect the level of the reference current Iref.

The closed loop transfer function of the control circuit TF is:

$$Tf=Ic/Iref=R0HGm/1+R0HGm$$

where H is the transfer function of the low pass filter 6 and Gm is the gain of the transconductance amplifier 8.

The transfer function demonstrates that the control circuit filters out varying components in the reference current such that the level of the control current Ic is controlled according to the average value of the reference current Iref. In this way, noise components which may be injected into the reference current are compensated for.

Figure 2:
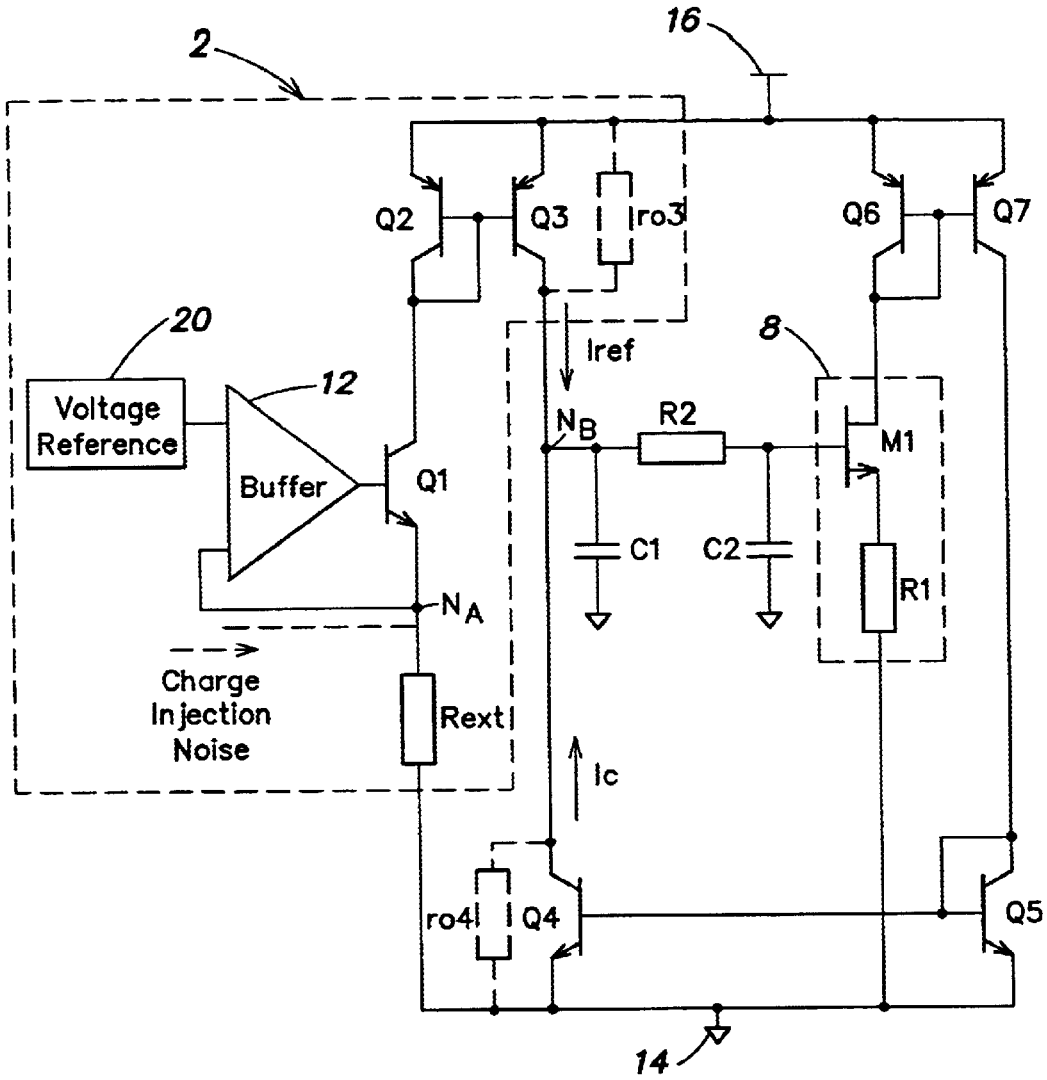
FIG. 2 is a circuit diagram of the current source.

FIG. 2 illustrates a schematic circuit diagram to implement the concept illustrated in FIG. 1B. The first current generator 2 for generating the reference current Iref comprises a reference voltage source 20 which supplies a reference voltage to one input of a buffer circuit 12. The output of the buffer circuit 12 feeds the base of the transistor Q1, the emitter of which is connected to a second input of the buffer circuit 12. The node NA in the path between the emitter of the transistor Q1 and the second input of the buffer circuit 12 is labelled to illustrate the point at which unwanted noise is sometimes injected to affect the value of the reference current Iref. That node NA is connected via an external resistor Rext to ground 14. The collector of the transistor Q1 is connected to a current source which comprises two base connected bipolar transistors Q2,Q3, the first of these transistors Q2 being connected in a diode configuration, with the emitters of both transistors being connected to a positive power supply rail 16, for example at 5V. The collector of the second of these transistors Q3 supplies the reference current Iref to a circuit node NB. The inherent output impedance of the transistor Q3 is labelled ro3 and is denoted in a dotted form to indicate that it is a parasitic resistance inherent within the transistor. It would be possible to add a separate series resistor if necessary to increase ro and improve the filtering.

The second current generator 4 comprises a similar pair of base connected transistors Q6,Q7, again with their emitters connected to the positive voltage supply rail 16, the first of these transistors Q6 being in a diode connected configuration and the second, Q7, having a collector on which the current is generated. That current is mirrored through a current mirror circuit consisting of transistors Q4,Q5 as the control current Ic into the leg of the circuit including the circuit node N13. The output current mirror transistor Q4 has a parasitic output impedance which is labelled ro4 and indicated in a dotted manner similarly to that of the transistor Q3. Once again a separate series resistor could be added if necessary to increase ro and improve the filtering.

The parallel combination of the output impedance ro3 and ro4 supplies a resistive component equivalent to the resistor labelled R0 in FIG. 1B. Thus, its value is controlled by the inherent output impedances ro3,ro4 of the transistors Q3 and Q4.

The low pass filter 6 is, thus constituted by the combined effect of these output impedances ro3,ro4 together with the circuit components illustrated in FIG. 2 being first and second capacitors C1,C2 and a resistor R2, The resistor R2 is connected between the circuit node NB and the input of the transconductance amplifier 8. The first capacitor C1 is connected between the first terminal of the resistor R2 arid ground. The second capacitor C2 is connected between the other terminal of the resistor R2 and ground.

The transconductance amplifier 8 comprises an NMOS transistor labelled M1 having its gate connected to the other terminal of the resistor R2, its drain connected to the diode connected transistor Q6 of the second current source and its source connected to a resistor R1 the other terminal of which is connected to ground 14.

As can be clearly seen from FIG. 2, the reference current Iref and the control current Ic are both supplied to the common circuit node NB such that a difference voltage Vin is generated there which is equal to (Iref-Ic)*R0, where R0 is, as already discussed, the value taken from the parallel combination of the output impedances ro3,ro4 of the transistors Q3,Q4. That voltage, Vin, is filtered by the low pass filter 6 and applied to the input of the transconductance amplifier thereby to control the value of the control current Ic in a feedback manner. In this way, the effect of noise is substantially filtered out from the reference current Iref so the control current more accurately reflects an average value of the originally intended reference level.

Having thus described at least one illustrative embodiment of the invention, various alterations, modifications, and improvements will readily occur to those skilled in the art. Such alterations, modifications, and improvements are intended to be within the spirit and scope of the invention. Accordingly, the foregoing description is by way of example only and is not intended as limiting. The invention is limited only as defined in the following claims and the equivalents thereto.

What is claimed is:

1. A current source for generating a control current comprising:

a reference current generator having a first output impedance and connected to supply a substantially constant reference current to a circuit node;

a control current generator having a second output impedance and connected to supply said control current to said circuit node;

whereby an input voltage is generated at said circuit node based on the substantially constant reference current, the control current and the first and second output impedances;

a filter circuit connected to said circuit node and arranged to filter said input voltage; and an amplifier connected to receive the filtered input voltage and arranged to control the level of said control current in dependence on the filtered input voltage.

2. A current source for generating a control current comprising:

a reference current generator having a first output impedance and connected to supply a reference current to a circuit node;

a control current generator having a second output impedance and connected to supply said control current to said circuit node;

whereby an input voltage is generated at said circuit node based on the reference current, the control current and the first and second output impedances;

a filter circuit connected to said circuit node and arranged to filter said input voltage; and an amplifier connected to receive the filtered input voltage and arranged to control the level of said control current in dependence on the filtered input voltage;

wherein the amplifier comprises a transistor having a source connected to a resistive component and a gate connected to receive the filtered input voltage.

3. A current source for generating a control current comprising:

a reference current generator having a first output impedance and connected to supply a reference current to a circuit node;

a control current generator having a second output impedance and connected to supply said control current to said circuit node;

whereby an input voltage is generated at said circuit node based on the reference current, the control current and the first and second output impedances;

a filter circuit connected to said circuit node and arranged to filter said input voltage; and an amplifier connected to receive the filtered input voltage and arranged to control the level of said control current in dependence on the filtered input voltage;

wherein the control current generator comprises a current source connected to a current mirror circuit which supplies said control current to said circuit node.

4. A current source for generating a control current comprising:

a reference current generator having a first output impedance and connected to supply a reference current to a circuit node;

a control current generator having a second output impedance and connected to supply said control current to said circuit node;

whereby an input voltage is generated at said circuit node based on the reference current, the control current and the first and second output impedances;

a filter circuit connected to said circuit node and arranged to filter said input voltage; and an amplifier connected to receive the filtered input voltage and arranged to control the level of said control current in dependence on the filtered input voltage;

wherein the filter circuit comprises a resistive component between said circuit node and the amplifier, and a capacitor connected between said resistor and a voltage supply terminal.

* * * * *

UNITED STATES PATENT AND TRADEMARK OFFICE

CERTIFICATE OF CORRECTION

PATENT NO. : 6,674,275 B2
DATED : January 6, 2004
INVENTOR(S) : Saul Darzy

It is certified that error appears in the above-identified patent and that said Letters Patent is hereby corrected as shown below:

Title page,
Item [75], Inventor, should read as follows:
-- [75] Inventor: Saul Darzy, Edgeware (GB) --

Column 4,
Line 62, should read: -- wherein the filter circuit comprises a resistive component connected --

Signed and Sealed this

Twenty-fifth Day of May, 2004

JON W. DUDAS
*Acting Director of the United States Patent and Trademark Office*